US007890037B2

(12) United States Patent
Rasch et al.

(10) Patent No.: US 7,890,037 B2
(45) Date of Patent: Feb. 15, 2011

(54) SELF ADJUSTING METAL STRIPPER FINGERS

(75) Inventors: Kenneth R. Rasch, Fairport, NY (US); Paul M. Fromm, Rochester, NY (US); Richard C. Benton, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 387 days.

(21) Appl. No.: 12/014,438

(22) Filed: Jan. 15, 2008

(65) Prior Publication Data

US 2009/0180819 A1 Jul. 16, 2009

(51) Int. Cl.
*G03G 15/20* (2006.01)

(52) U.S. Cl. ..... 399/323

(58) Field of Classification Search ..... 399/323
See application file for complete search history.

(56) References Cited

U.S. PATENT DOCUMENTS 4,055,874 A * 11/1977 Brown ..... 24/67.3
6,490,428 B1 * 12/2002 Fromm et al. ..... 399/323
2008/0138123 A1 * 6/2008 Kondoh et al. ..... 399/323

* cited by examiner

*Primary Examiner*—Constantine Hannaher
(74) *Attorney, Agent, or Firm*—Richard A. Castellano; Prass LLP

(57) ABSTRACT

A plurality of stripper fingers in a fuser assembly are provided to assist in preventing damage to the fuser roll caused by prior art fingers. In the present invention, skiis are positioned away back from the tip of the stripper finger. These skiis extend beyond the lower surface of the stripper finger and are enabled to lift the tip away from the fuser surface during a paper jam or hard stripping situation.

10 Claims, 4 Drawing Sheets

SELF ADJUSTING METAL STRIPPER FINGERS

This invention relates to paper handling systems, and more specifically, to stripping mechanisms useful in roll or belt assemblies.

BACKGROUND

While the present invention can be effectively used in a plurality of paper handling systems that utilize finger stripping elements to remove paper from rolls or belts, it will be described for clarity as used in electrostatic marking systems, such as electrophotography.

Generally, in a commercial electrophotography marking or reproduction apparatus (such as copier/duplicators, printers, multifunctional systems or the like), a latent image charge pattern is formed on a uniformly charged photoconductive or dielectric member. Pigmented marking particles (toner) are attracted to the latent image charge pattern to develop this image on the dielectric member. A receive member, such as paper, is then brought into contact with the dielectric or photoconductive member, and an electric field applied to transfer the marking particle developed image to the receiver member from the dielectric member. After transfer, the receiver member bearing the transferred image is transported away from the dielectric member to a fusion station, and the image is fixed or fused to the receiver member by heat and/or pressure to form a permanent reproduction thereon. The receiving member passes between a pressure roll and a heated fuser roll or element.

An electrographic fuser element generally includes metallic substrates, such as aluminum, an elastomeric cover layer, usually a silicone, and at least one coating over the silicone, generally made of a fluoropolymer, such as Teflon® (a trademark of DuPont).

Sometimes copies made in Xerographic or electrostatic marking systems have defects caused by improper fusing of the marking material or the fuser itself. The incomplete fusing can be the result of many factors, such as defects in the pressure or fuser rolls. Defects in the fuser rolls can be caused by improper compression set properties resulting from extended use or improper coating of the fuser substrates during manufacture. Another cause of defects in the fuser roll is caused by paper stripping fingers that gouge the fuser roll surface.

This invention and its various embodiments are concerned with improving the performance and extending the life of these coated fuser elements, including fuser rolls and other configurations. While for clarity the term "fuser roll structure or member" will be used throughout this disclosure and claims, any suitable fusing configurations are intended to be included, such as rolls, belts, and pressure members.

There is a tendency during the fusing step for the print substrate to remain tacked to the fuser roll after passing through the nip between the fuser roll and the pressure roll despite use of low surface energy materials. If this occurs, the tacked print substrate does not follow the normal substrate path but rather continues in an arcuate path around the fuser roll, which eventually causes a paper jam. This then requires an operator to manually remove the jammed paper before any subsequent imaging cycle can proceed. In an attempt to correct this, it has been common practice to ensure that the print substrate is stripped from the fuser roll downstream of the fuser nip. One approach is the use of a plurality (4-6) of stripper fingers placed in angular spring contact with the surface of the fuser roll in order to strip the print substrate from the fuser roll. This practice often suffers from difficulties with respect to both fuser roll life and print quality. To ensure an acceptable level of stripping, it is frequently necessary to load such a stripper finger against the fuser roll with such a force and at such an attack angle that there is a tendency to peel the silicone rubber surface off the fuser roll, thereby damaging the roll to such an extent that it must be replaced or can no longer effectively function as a fuser roll.

Stripping copies off rubber covered rollers is not easy. The balance between tip load and attach angle is critical to roll and finger wear and failure to strip copies or worse yet, digging into the soft rubber. For years companies have used a steel strip as a finger that deforms under stripped paper load or a rigid plastic design that does not significantly change shape as a function of load. These types of fingers tend to damage the rubber on covered rolls with great ease during jamming or hard stripping situations, rigid fingers are much worse.

SUMMARY

Embodiments of the present invention involve the use of steel stripper finger with fuser roll contact skis positioned such that the applied load during an excessive stripping condition or a jam condition is supported by the skis against the fuser roll thereby preventing the finger tip from damaging the soft roll surface. The purpose of the metal ski feature (which could be made of other materials) is to lift the stripping tip off the fuser roll when paper loads the finger and deforms the steel supporting beam. The skis extend below the surface of the finger tip and have a configuration similar to a bent elbow, with the rounded elbow portion enabled to contact the fuser roll surface. The steel provides flexibility to auto adjust to paper loads while the ski shape and position can eliminate roll damage. The critical shape on the roll side of the finger is a smooth rounded shape approximately 6 mm behind the tip that contacts the fuser roll with small deflections of the steel support. The use of the metal as a finger material also reduces the cost of the part due to design simplification and manufacturing approach and reduced wear rate of the finger tip.

This invention provides, as above noted, a fuser stripper finger design that prevents a common problem in Teflon® over Silicone (TOS) rolls. Under hard stripping conditions or during paper jams, paper exerts enough force on stripper fingers to gouge the soft TOS roll rendering it useless. The disclosed design prevents this gouging via tab like ski features that contact the roll during a jam and deflect the sharp tip away from the surface of the roll. An additional hump feature is provided to minimize the width of any stripper finger marks on prints. The finger is made of steel and coated in a release material (possibly Teflon®) rather than the traditional all plastic design.

For years companies have used a steel strip as a finger that deforms under stripped paper load. The stripping of a copy occurs in two stages. First and most challenging is to get the leading edge of the copy off the fuser roll when it is adhered with toner. After the leading edge is stripped, the finger is simply peeling the body of the sheet off the roll, again with toner as the adhesive. The magnitude of the stickiness of the toner is similar to Scotch Tape since a good finger can easily strip it off a cold fuser roll.

To strip the lead edge, the attach angle of the finger (angle from the roll side of the finger to the tangent of the roll at the tip contact point) needs to be about 15 degrees and the load about 25 grams. (These are approximate values and change a little depending on the roll surface and release agent presence). As the paper edge hits the finger tip, it imparts a force to the finger tangent to the roll. The flexible fingers are stiff enough that this loading results in very little shape change and the finger slides between the paper and the roll. The load is trying to increase the curvature of "pre-buckled" column that is fairly short and stiff.

After the lead edge is stripped, the sheet is able to exert a force on the finger that is near radial to the roll or normal to the long axis of the steel strip. Now the loading case is more like a distributed load over a simply supported beam. This radial force comes from the image on both sides of the finger pulling the paper towards the roll while the finger is trying to guide it away from the roll. Or, many times higher loads are exerted on the finger by a jammed sheet or sheets of paper. The effect of the radial load is to increase the tip load and in the case of a flexible finger, reduce the attach angle by causing the simply supported beam to bend more.

As the sheet is stripped, the attach angle is fairly high and the load fairly low, but after the lead edge is stripped, if high stripping forces are present, the tip load will go up but the attach angle goes down in a proportional manner. Reducing attach angle as the load goes up is key to preventing roll gouging and helpful in reducing roll wear. In the case of a jam or other sources of very high load, deformation continues until the ski lifting feature contacts the fuser roll and lifts the tip off the roll so it cannot damage or wear the soft roll surface. As the metal supporting beam deforms the attach angle of the tip reduces about 5 degrees and then the support ski contacts the roll and subsequent deformation of the steel causes the sharp tip to lift off the roll completely. It is then unable to damage the roll surface even as paper loads on the finger get large, such as during a jam. This has been demonstrated on the fuser system to prevent roll damage that is frequent if this feature is not present.

DETAILED DISCUSSION OF DRAWINGS AND PREFERRED EMBODIMENTS

Figure 1A:
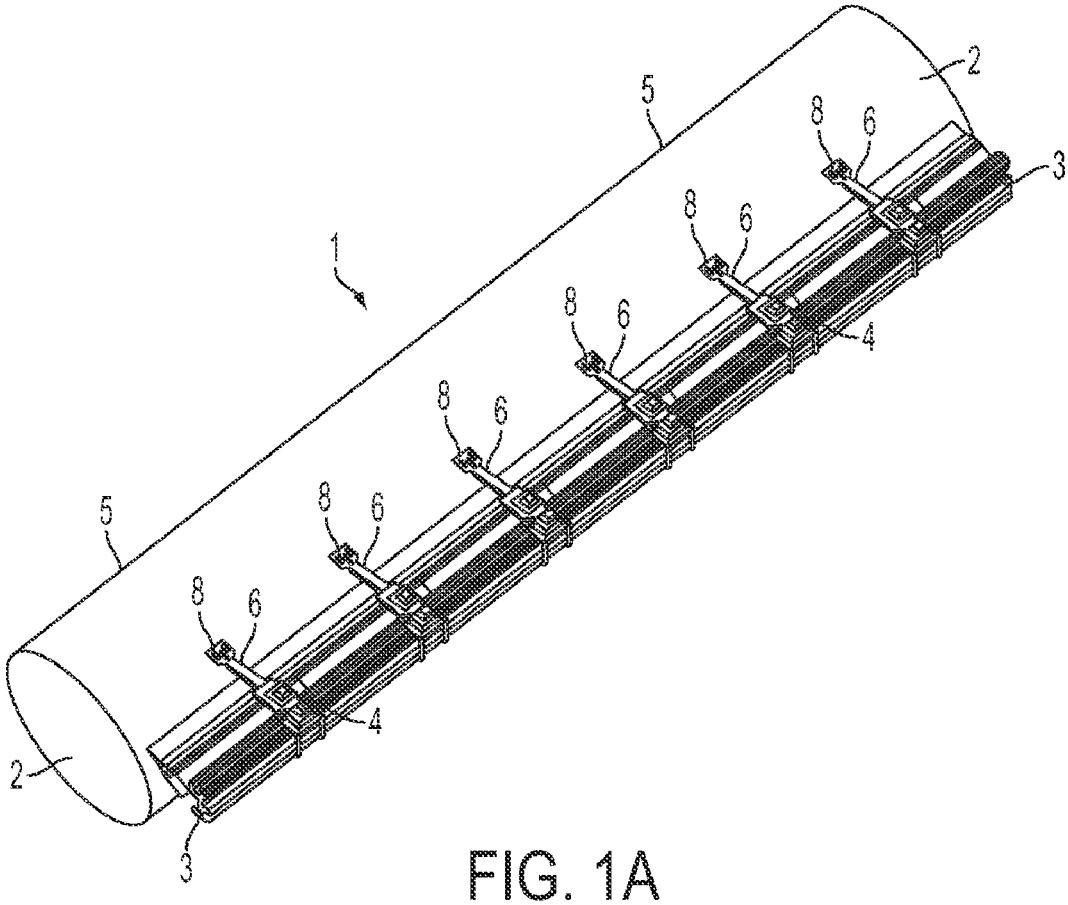
FIG. 1A is a perspective top view of a fusing assembly with a fuser roll and stripper fingers of an embodiment of this invention.
Figure 1B:
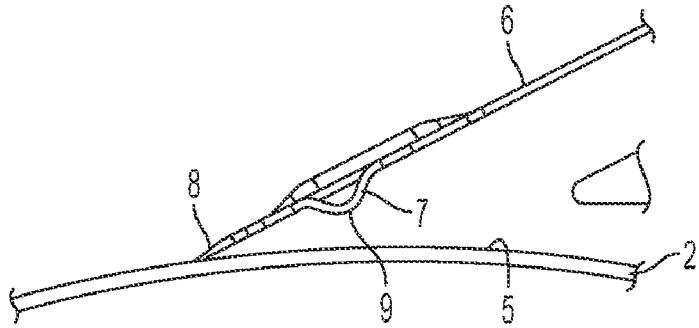
FIG. 1B is an enlarged side view of this embodiment, showing the finger's position in normal operations.
Figure 2:
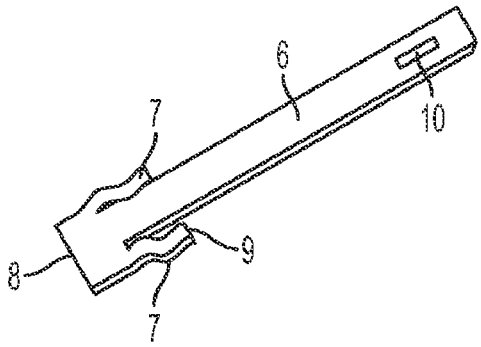
FIG. 2 is a top perspective view of an embodiment of a stripper finger of this invention.

In FIG. 1A, fuser roll assembly 1 is illustrated in a top perspective view. The fuser roll 2 has a surface 5 generally a low surface energy elastomer such as Teflon® over silicone (TOS), or rubber materials. These surfaces can be seriously damaged by fingers contacting the surface at the wrong angle or with excessive pressure. In the embodiment of FIG. 1A, six stripper fingers 6 are used in spring loaded stripping contact with the surface 5 of the fuser roll 2. Any suitable number of fingers 6 may be used; it is common to use from 3-8 fingers 6. The metal fingers 6 are preferably totally coated with Teflon® (a trademark of DuPont), but may be partially coated if suitable for a specific use. This Teflon coating helps to minimize toner adhesion to the finger 6 and also prevents any rusting. The use of the steel fingers of the present invention provides a vast reduction in finger cost of approximately ⅕ of the cost of prior art fingers. In FIG. 1B an enlarged side view of the fingers 6 as they contact fuser roll surface 5 is shown. The tip 8 makes pressure contact with surface 5 during normal operations, i.e., when there is no paper jam. The elbow-shaped skis 7 of the stripper fingers as in FIGS. 2-4 generally do not touch the fuser roll 2 during normal operations, but during excessive stripping conditions such as rumpled paper 11 or during paper jams, the skis 7/9 lift the finger tip 8, thereby preventing the finger tip 8 from damaging the soft surface 5 of the fuser roll 2. The steel provides flexibility to auto adjust to paper loads while the ski shape and position can eliminate or minimize roll 2 damage. The skis 7 can be described as having a bent elbow like configuration 9 with the rounded elbow portion contacting the roll 2 during a paper jam or irregular paper surface 11, thereby lifting tip 8 away from the surface 5 of roll 2. The stripper fingers 6 of this invention can be used in any situation or system using any stripping mechanism with cut sheets and sheet carrying roll or belt or the like.

In FIGS. 1A and 1B, a fusing assembly useful in a marking apparatus is illustrated. This assembly 1 comprises a fuser structure 2, a spring loaded mount support 3 for stripper fingers 6 and a plurality of bar-like stripper fingers 6 of this invention. The mount support 3 is enabled to support said plurality of stripper fingers 6 in alignment adjacent to and in alignment with the surface of said fuser structure 5. The stripper fingers 6 are spring mounted on both the support 3 and spring loaded baffles 4 and are enabled to contact the fuser structure 2 with a spring force when in contact therewith. The stripper fingers of this invention comprise a connector 10 and spring-loaded baffles 4 (see FIGS. 1A and 4) and at its rear section and an elongated strip having at a first end a stripping tip 8. Behind said tip 8 is located at least two ski elements 7. These ski elements 7 are enabled to lift the stripping tip 8 off the fuser structure 5 when paper or other substrates load the finger 6.

Figure 3A:
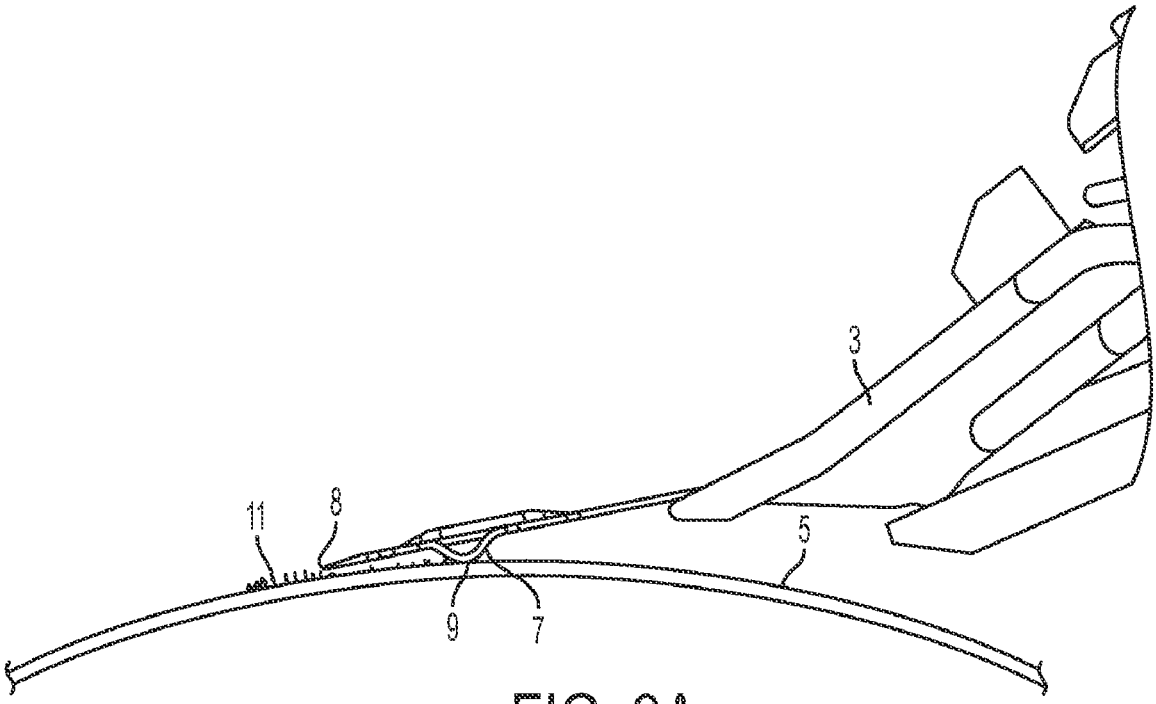
FIG. 3A is a side plan view of an embodiment of a stripper finger of this invention as it raises the tip of the finger above the fuser roll surface when paper is crushed or rumpled.
Figure 3B:
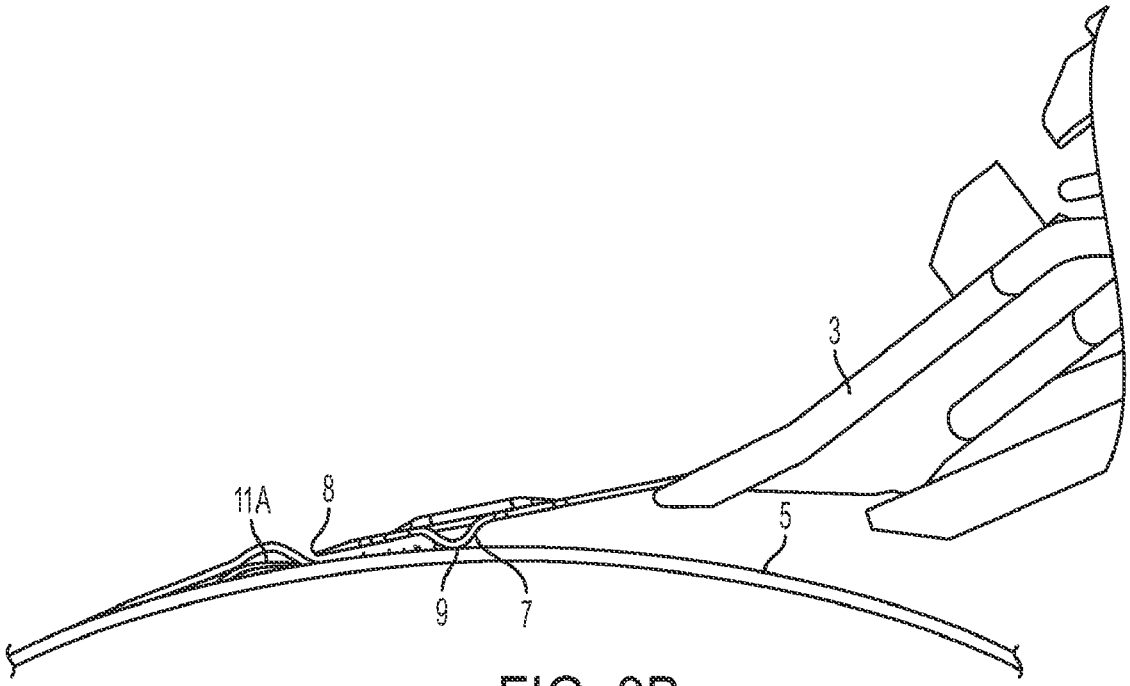
FIG. 3B is a side plan view of the stripper finger raised when there is a paper jam.
Figure 4:
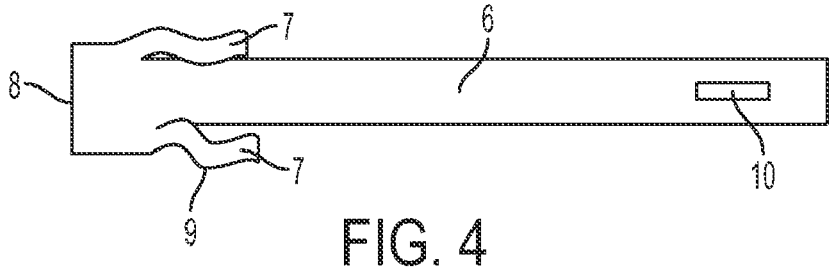
FIG. 4 is a top plan view of an embodiment of a stripper finger of this invention.

In FIG. 3 a side view of the stripper finger 6 is shown as crushed or rumpled paper 11 contacts the elbow 9 portion of ski 7 and lifts the finger tip 8 from contact with surface 5 or the fuser (or other) roll. When the paper jams as in FIG. 3B as shown at 11A, the substrate jams at the front 8 or, more commonly, the top surface of finger tip 8, the driving force of the sheet combined or in addition to the stickiness of the toner results in excessive force that bends the finger and increases the force it applies against the roll. The ski 7 lifts the tip of the finger off the roll as the finger deflects preventing fuser roll 2 damage. (Non-jam condition) —when excessive paper/toner stripping force is encountered, the ski 7 prevents the tip of the finger 8 from damaging the fuser roll surface 5. This non-jam cause is exacerbated by non-traditional media.

Figure 5A:
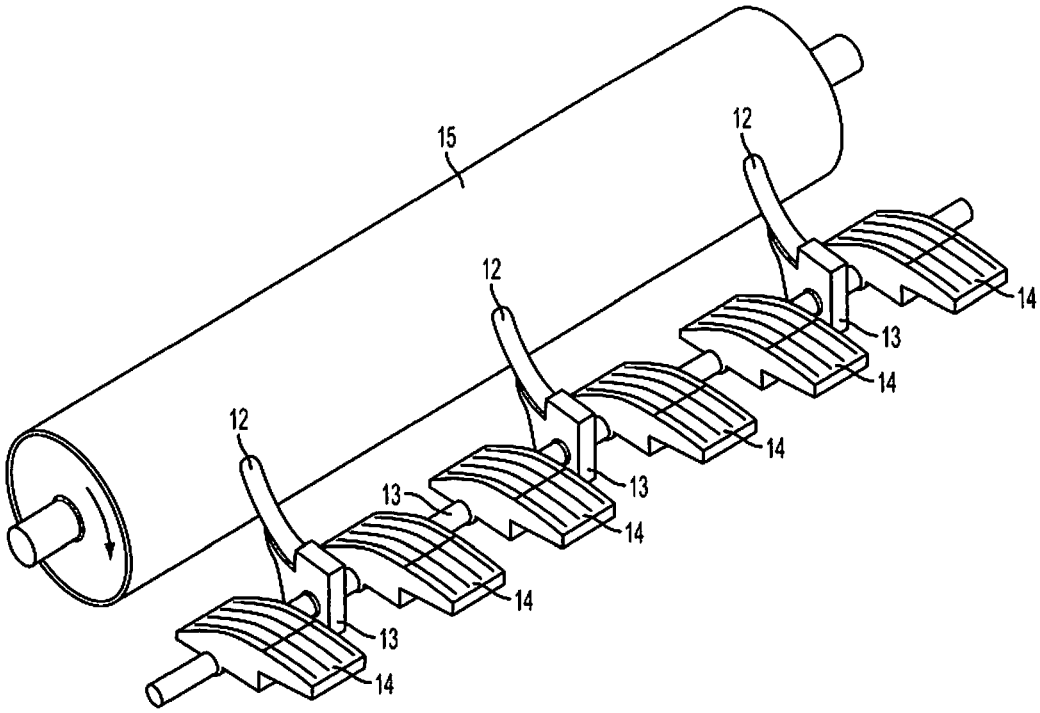
FIG. 5A PRIOR ART
FIG. 5A is a top elevational view of a typical prior art fusing assembly using prior art fingers.
Figure 5B:
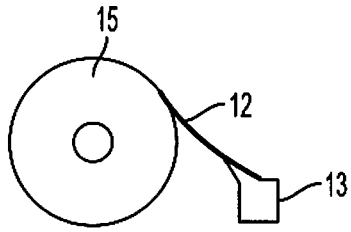
FIG. 5B PRIOR ART
FIG. 5B is a side view showing the general configuration of a prior art finger.

FIG. 5A is a top elevational view of a prior art fuser assembly with a roll 15 as shown having stripper fingers 12 without any skis as in the present invention. The fingers 12 are attached to supports 13 between baffles 14. The baffles 14 in this prior art configuration provide surfaces against which mis-stripped papers crumble. FIG. 5B is a side view showing the general configuration of a prior art finger. Note that the prior art fingers have no skis 7 as in the present invention.

In the disclosure and claims the listed terms or phrases will have the following meaning: The stripper finger has a flat configuration-means, a flexible bar-like configuration with a thickness of from about 0.05 to 0.2 mm. The skis are located behind said tip-means; the elbow shaped skis are positioned from 2 to 8 mm behind said tip of the stripper finger; front end or tip or terminal portion means that tip that contacts the paper carrying surface, initially exert pressure-means before the skis contact the surface.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A fusing assembly useful in an electrophotographic marking apparatus comprising:

a fuser structure and paper finger strippers configured to contact said structure with a spring force when urged against said structure, said structure selected from the group consisting of fuser rolls, fuser belts, and combinations thereof, said finger strippers comprising an elongated strip having at a first front end a stripping tip and behind said tip at least two bent elbow-shaped ski elements, said ski elements attached to and horizontally extending below said stripping tip, said elements configured to lift said stripping tip off the fuser structure when paper/substrates loads the said finger strippers.

2. The fusing assembly of claim 1 wherein said ski elements have a bent-elbow configuration below said strip when said finger strippers are viewed from a side view.

3. The fusing assembly of claim 1 wherein said finger strippers are constructed of a flexible metal having a protective plastic coating thereon.

4. The fusing assembly of claim 1 wherein said bent elbow-shaped ski elements are located about 3-8 mm behind said stripping tip and extending below said stripping tip to a horizontal plane below said stripping tip.

5. The fusing assembly of claim 1 wherein said bent elbow-shaped ski elements are configured to guide said stripping tip at a distance away from said fuser structure and configured to maintain said distance until a paper jam is corrected.

6. The fusing assembly of claim 1 wherein said bent elbow-shaped ski elements are configured to guide said stripping tip in a manner that there is substantially no pressure of said stripping tip on said fuser structure if high stripping forces are present.

7. The fusing assembly of claim 1 wherein said bent elbow-shaped ski elements are configured to lift the stripping tip off the fuser structure so that said stripping tip cannot damage or wear a surface of said fuser structure.

8. The fusing assembly of claim 1 wherein said stripper finger is configured to be in contact with said fuser structure at an angle of about 10 degrees to about 20 degrees.

9. A fusing assembly useful in an electrographic marking apparatus, said assembly comprising:

a fuser structure, a spring-loaded mount support for stripper fingers and a plurality of bar-like stripper fingers, said mount support configured to support said plurality of said bar-like stripper fingers adjacent to and in alignment with a surface of said fuser structure, said stripper fingers being spring mounted on said support and configured to contact said fuser structure with a spring force when in contact therewith, said stripper fingers comprising a connector at a rear section and an elongated strip having at a first front end a stripping tip and behind said tip at least two bent elbow-shaped ski elements, said elements configured to lift said stripping tip off the fuser structure when paper or other substrate loads the finger.

10. The fuser assembly of claim 9, wherein said bar-like stripper fingers have a configuration comprising said stripping tip at its front section and said connector at the rear section, said finger comprising said bent elbow-shaped skis that extend below a lower surface of said bar-like stripper fingers, said bent elbow-shaped skis configured to contact said fuser structure surface and thereby lift said stripping tip from engagement with said fuser structure surface.

* * * * *